US010510292B2

(12) United States Patent
Jang

(10) Patent No.: US 10,510,292 B2
(45) Date of Patent: Dec. 17, 2019

(54) ORGANIC LIGHT EMITTING DISPLAY DEVICE AND DRIVING METHOD THEREOF

(71) Applicant: LG Display Co., Ltd., Seoul (KR)

(72) Inventor: Haejong Jang, Incheon (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 15/792,526

(22) Filed: Oct. 24, 2017

(65) Prior Publication Data

US 2018/0122300 A1 May 3, 2018

(30) Foreign Application Priority Data

Oct. 31, 2016 (KR) ..... 10-2016-0142744

(51) Int. Cl.
*G09G 5/10* (2006.01)
*G09G 3/3233* (2016.01)
*G09G 3/3258* (2016.01)

(52) U.S. Cl.
CPC ..... *G09G 3/3233* (2013.01); *G09G 3/3258* (2013.01); *G09G 2310/08* (2013.01); *G09G 2320/046* (2013.01); *G09G 2320/0626* (2013.01)

(58) Field of Classification Search
USPC ..... 345/690, 691, 174, 214, 82, 212, 207
See application file for complete search history.

(56) References Cited

U.S. PATENT DOCUMENTS

2009/0046089 A1* 2/2009 Zhuang ..... G09G 3/22 345/214
2010/0134535 A1* 6/2010 Shidara ..... G09G 3/20 345/690
2011/0157253 A1* 6/2011 Yamazaki ..... G02F 1/133555 345/690
2014/0071031 A1* 3/2014 Tomida ..... G09G 3/3233 345/82
2014/0092075 A1* 4/2014 Lee ..... G05F 1/468 345/212
2015/0062103 A1* 3/2015 Tatsumi ..... G09G 3/30 345/207
2015/0130850 A1* 5/2015 Wyatt ..... G09G 3/342 345/690
2015/0339967 A1* 11/2015 Shin ..... G06F 3/1446 345/690
2015/0364107 A1* 12/2015 Sakariya ..... G06F 3/0412 345/174
2016/0379584 A1* 12/2016 Onishi ..... G09G 3/3648 345/691

* cited by examiner

*Primary Examiner* — Thuy N Pardo
(74) *Attorney, Agent, or Firm* — Seed IP Law Group LLP

(57) ABSTRACT

Disclosed are an organic light emitting display device and a driving method thereof, which prevent an OLED of each pixel from being burned in even when still images are continuously displayed on a display panel. When a certain time elapses after a display panel enters a PSR mode of displaying a still image, a timing controller may progressively decrease the control duty ratio for controlling the luminance of the display panel. Also, the timing controller prevents the OLED from being burned in when a still image is displayed.

12 Claims, 5 Drawing Sheets

ORGANIC LIGHT EMITTING DISPLAY DEVICE AND DRIVING METHOD THEREOF

CROSS-REFERENCE TO RELATED APPLICATIONS

This application claims the benefit of the Korean Patent Application No. 10-2016-0142744 filed on Oct. 31, 2016, which is hereby incorporated by reference in its entirety as if fully set forth herein.

BACKGROUND

Technical Field

The present disclosure relates to an organic light emitting display device and a driving method thereof.

Description of the Related Art

In information-oriented society, a number of technologies relevant to display devices for displaying visual information as an image or a video are being developed. The display devices each include a display panel that includes a display area where a plurality of pixels for displaying an image are provided and a non-display area which is disposed outside the display area and does not display an image, a gate driver that inputs a gate signal to the pixels, a plurality of source drive integrated circuits (ICs) that input data voltages to the pixels, and a timing controller that inputs signals for controlling the gate driver and the plurality of source drive ICs.

The timing controller is included in a sync side, and the sync side includes a remote frame buffer (RFB) separately from the timing controller.

The timing controller is supplied with digital video data from an external source side. In this case, as the source side supplies the digital video data to more number of frames, power consumed by the source side increases.

A panel self-refresh (PSR) mode is applied to still images. In the PSR mode, the source side determines whether supplied digital video data represents a still image. When it is determined that the digital video data represents a still image, the sync side stores the digital video data in the remote frame buffer included therein. When the digital video data is stored in the remote frame buffer, the source side stops the supply of the digital video data. The sync side autonomously drives the display panel with the digital video data stored in the remote frame buffer.

Examples of the display devices include liquid crystal display (LCD) devices, field emission display (FED) devices, plasma display panels (PDPs), organic light emitting display devices, etc. In the display devices, the organic light emitting display devices display an image by using an organic light emitting diode (OLED) which emits light through a recombination of a hole and an electron. The organic light emitting display devices have a fast response time and maximally realize a low gray level by self-emitting light, and thus, are attracting much attention as next-generation display devices.

The PSR mode is able to be applied to a case where still images are repetitively displayed. When the PSR mode is applied to an organic light emitting display device, still images are continuously displayed on the display panel. When the still images are continuously displayed on the display panel, an OLED of a pixel provided in a specific area of the display panel displaying an area where a luminance of the still images is high is burned in.

BRIEF SUMMARY

Accordingly, the present disclosure is directed to provide an organic light emitting display device and a driving method thereof that substantially obviate one or more problems due to limitations and disadvantages of the related art.

An aspect of the present disclosure is directed to provide an organic light emitting display device and a driving method thereof, which prevent an OLED of each pixel from being burned in even when still images are continuously displayed on a display panel.

Additional advantages and features of the disclosure will be set forth in part in the description which follows and in part will become apparent to those having ordinary skill in the art upon examination of the following or may be learned from practicing the disclosure. The objectives and other advantages of the disclosure may be realized and attained by the structure particularly pointed out in the written description and claims hereof as well as the appended drawings.

To achieve these and other advantages and in accordance with the purpose of the disclosure, as embodied and broadly described herein, there is provided an organic light emitting display device including a display panel for displaying an image, a data driver for supplying a data voltage to the display panel, and a timing controller for controlling the data driver.

In another aspect of the present disclosure, there is provided a driving method of an organic light emitting display device including controlling, by a timing controller, a data driver, supplying, by the data driver, a data voltage to a display panel, and displaying, by the display panel, an image.

When a certain time elapses after the display panel enters a panel self-refresh (PSR) mode of displaying a still image, the timing controller may progressively reduce a control duty ratio which controls a luminance of the display panel.

It is to be understood that both the foregoing general description and the following detailed description of the present disclosure are examples and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION

Figure 1:
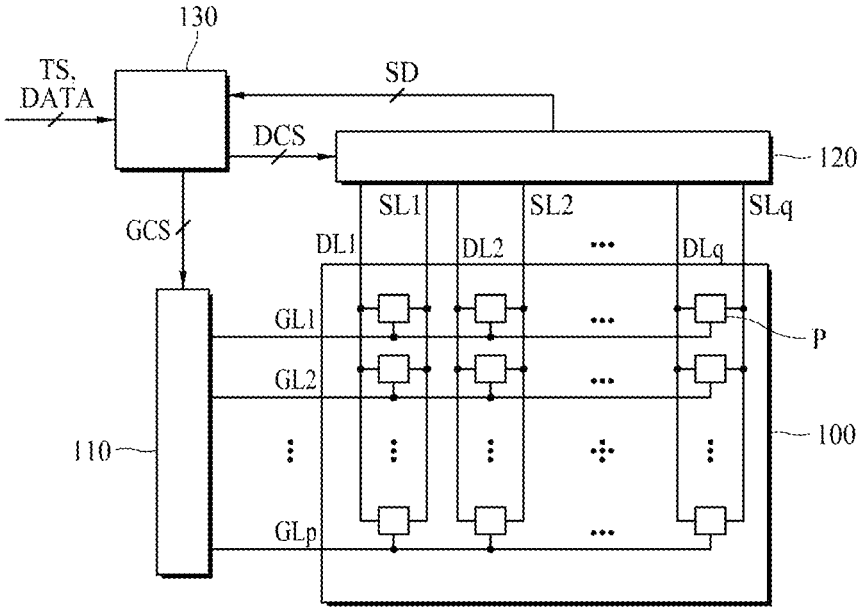
FIG. 1 is a block diagram of an organic light emitting display device according to an embodiment of the present disclosure.

Reference will now be made in detail to the example embodiments of the present disclosure, examples of which are illustrated in the accompanying drawings. Wherever possible, the same reference numbers will be used throughout the drawings to refer to the same or like parts.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted.

In a case where 'comprise', 'have', and 'include' described in the present specification are used, another part may be added unless 'only~' is used. The terms of a singular form may include plural forms unless referred to the contrary.

In construing an element, the element is construed as including an error range although there is no explicit description.

In describing a position relationship, for example, when a position relation between two parts is described as 'on~', 'over~', 'under~', and 'next~', one or more other parts may be disposed between the two parts unless 'just' or 'direct' is used.

In describing a time relationship, for example, when the temporal order is described as 'after~', 'subsequent~', 'next~', and 'before~', a case which is not continuous may be included unless 'just' or 'direct' is used.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

An X axis direction, a Y axis direction, and a Z axis direction should not be construed as only a geometric relationship where a relationship therebetween is vertical, and may denote having a broader directionality within a scope where elements of the present disclosure operate functionally.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Features of various embodiments of the present disclosure may be partially or overall coupled to or combined with one another, and may be variously inter-operated with one another and driven technically as those skilled in the art can sufficiently understand. The embodiments of the present disclosure may be carried out independently from one another, or may be carried out together in co-dependent relationship.

Hereinafter, example embodiments of the present disclosure will be described in detail with reference to the accompanying drawings.

FIG. 1 is a block diagram of an organic light emitting display device according to an embodiment of the present disclosure. The organic light emitting display device according to an embodiment of the present disclosure may include a display panel 100, a gate driver 110, a data driver 120, and a timing controller (T-CON) 130.

The display panel 100 may include a display area and a non-display area provided near the display area. The display area may be an area where a plurality of pixels P are provided to display an image. A plurality of gate lines GL1 to GLp (where p is a positive integer equal to or more than two), a plurality of data lines DL1 to DLq (where q is a positive integer equal to or more than two), and a plurality of sensing lines SL1 to SLq may be provided in the display panel 100. The plurality of data lines DL1 to DLq and the plurality of sensing lines SL1 to SLq may intersect the plurality of gate line GL1 to GLp. The plurality of data lines DL1 to DLq and the plurality of sensing lines SL1 to SLq may be parallel to one another. The display panel 100 may include a lower substrate, where the pixels P are provided, and an upper substrate that performs an encapsulation function.

Each of the pixels P may be connected to one corresponding gate line of the gate lines GL1 to GLp, one corresponding data line of the data lines DL1 to DLq, and one corresponding sensing line of the sensing lines SL1 to SLq. Each of the pixels P may include an organic light emitting diode OLED and a pixel driver PD that supplies a current to the organic light emitting diode OLED.

Figure 2:
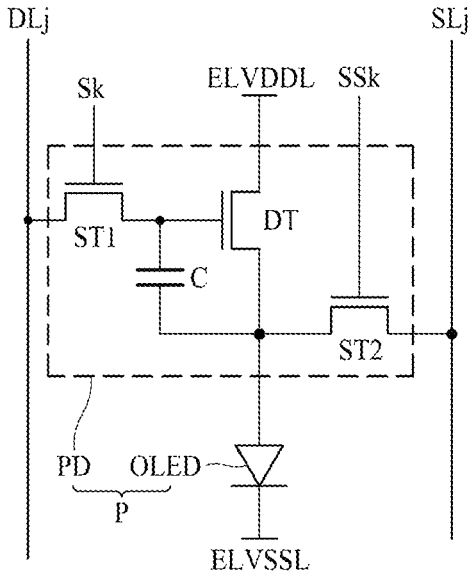
FIG. 2 is a circuit diagram illustrating in detail a pixel according to an embodiment of the present disclosure.

FIG. 2 is a circuit diagram illustrating in detail a pixel according to an embodiment of the present disclosure. In FIG. 2, for convenience of description, only a pixel P connected to a jth (where j is a positive integer satisfying $1 \leq j \leq q$) data line DLj, a jth sensing line SLj, a kth (where k is a positive integer satisfying $1 \leq k \leq p$) scan line Sk, and a kth sensing signal line SSk is illustrated. The pixel P may include an organic light emitting diode OLED and a pixel driver PD that supplies a current to the organic light emitting diode OLED and the jth sensing lines SLj.

The organic light emitting diode OLED may emit light with a current supplied through a driving transistor DT. An anode electrode of the organic light emitting diode OLED may be connected to a source electrode (or drain electrode) of the driving transistor DT, and a cathode electrode may be connected to a low level voltage line ELVSSL through which a low level voltage lower than a high level voltage is supplied.

The organic light emitting diode OLED may include the anode electrode, a hole transporting layer, an organic light emitting layer, an electron transporting layer, and the cathode electrode. In the organic light emitting diode OLED, when a voltage is applied to the anode electrode and the cathode electrode, a hole and an electron may respectively move to the hole transporting layer and the electron transporting layer and may be combined with one another to emit light in the organic light emitting layer.

The pixel driver PD may include the driving transistor DT, a first transistor ST1 controlled by a scan signal of the scan line Sk, a second transistor ST2 controlled by a sensing signal of the sensing signal line SSk, and a capacitor C. In a display mode, when the scan signal is supplied through the scan line Sk connected to the pixel P, the pixel driver PD may be supplied with a data voltage VDATA of the data line DLj connected to the pixel P, and a current of the driving transistor DT based on the data voltage VDATA may be supplied to the organic light emitting diode OLED. In a sensing mode, when the scan signal is supplied through the scan line Sk connected to the pixel P, the pixel driver PD may be supplied with a sensing voltage of the data line DLj connected to the pixel P, and a current of the driving transistor DT may flow to the sensing line SLj connected to the pixel P.

The driving transistor DT may be provided between the high level voltage line ELVDDL and the organic light emitting diode OLED. The driving transistor DT may control a current flowing from the high level voltage line ELVDDL to the organic light emitting diode OLED, based on a voltage difference between a gate electrode and a source electrode of the driving transistor DT. The gate electrode of the driving transistor DT may be connected to a first electrode of the first transistor ST1, the source electrode may be connected to the anode electrode of the organic light emitting diode OLED, and a drain electrode may be connected to the high level voltage line ELVDDL through which the high level voltage is supplied.

The first transistor ST1 may be turned on by a kth scan signal of the kth scan line Sk and may supply a voltage of the jth data line DLj to the gate electrode of the driving transistor DT. A gate electrode of the first transistor ST1 may be connected to the kth scan line Sk, a first electrode may be connected to the gate electrode of the driving transistor DT, and a second electrode may be connected to the jth data line DLj. The first transistor ST1 may be referred to as a scan transistor.

The second transistor ST2 may be turned on by a kth sensing signal of the kth sensing signal line SSk and may connect the jth sensing line SLj to the source electrode of the driving transistor DT. A gate electrode of the second transistor ST2 may be connected to the kth sensing signal line SSk, a first electrode may be connected to the jth sensing line SLj, and a second electrode may be connected to the source electrode of the driving transistor DT. The second transistor ST2 may be referred to as a sensing transistor.

The capacitor C may be provided between the gate electrode and the source electrode of the driving transistor DT. The capacitor C may store a difference voltage between a gate voltage and a source voltage of the driving transistor DT.

In FIG. 2, an example where the driving transistor DT and the first and second transistors ST1 and ST2 are each formed of an N-type metal oxide semiconductor field effect transistor (MOSFET) has been described, but the present disclosure is not limited thereto. The driving transistor DT and the first and second transistors ST1 and ST2 may each be formed of a P-type MOSFET. Also, the first electrode may be a source electrode, and the second electrode may be a drain electrode. However, the present embodiment is not limited thereto. In other embodiments, the first electrode may be a drain electrode, and the second electrode may be a source electrode.

In the display mode, when the scan signal is supplied to the kth scan line Sk, the data voltage VDATA of the jth data line Dj may be supplied to the gate electrode of the driving transistor DT, and when the sensing signal is supplied to the kth sensing signal line SSk, an initialization voltage of the jth sensing line SLj may be supplied to the source electrode of the driving transistor DT. Therefore, in the display mode, a current of the driving transistor DT which flows according to a voltage difference between a voltage at the gate electrode and a voltage at the source electrode of the driving transistor DT may be supplied to the organic light emitting diode OLED, and the organic light emitting diode OLED may emit light with the current of the driving transistor DT. In this case, the data voltage VDATA may be a voltage generated by compensating for a threshold voltage and an electron mobility of the driving transistor DT, and thus, the current of the driving transistor DT does not depend on the threshold voltage and electron mobility of the driving transistor DT.

In the sensing mode, when the scan signal is supplied to the kth scan line Sk, a sensing voltage of the jth data line Dj may be supplied to the gate electrode of the driving transistor DT, and when the sensing signal is supplied to the kth sensing signal line SSk, the initialization voltage of the jth sensing line SLj may be supplied to the source electrode of the driving transistor DT. Also, when the sensing signal is supplied to the kth sensing signal line SSk, the second transistor ST2 may be turned on, and thus, the current of the driving transistor DT which flows according to the voltage difference between the voltage at the gate electrode and the voltage at the source electrode of the driving transistor DT may flow to the jth sensing line SLj.

The gate driver 110 may be supplied with a gate driver control signal GCS from the timing controller 130. The gate driver 110 may generate gate signals according to the gate driver control signal GCS. The gate driver 110 may supply the gate signals to the gate lines GL1 to GLp. The gate driver 110 may be mounted in a non-display area of the display panel 100 in a gate drive in panel (GIP) type. Alternatively, the gate driver 110 may be implemented as a gate drive IC (GD-IC).

The data driver 120 may be supplied with a data driver control signal DCS from the timing controller 130. The data driver 120 may generate data voltages, based on the data driver control signal DCS. The data driver 120 may supply the data voltages to the data lines DL1 to DLq.

The data driver 120 may include a plurality of source drive ICs. The source drive ICs may be respectively mounted on a plurality of flexible films. Each of the flexible films may be provided as a chip on film (COF). The COF may include a base film, such as polyimide, and a plurality of conductive lead lines provided on the base film. The flexible films may be bent or curved. The flexible films may each be attached on a lower substrate of the display panel 100 and a control printed circuit board (C-PCB). Particularly, each of the flexible films may be attached on the lower substrate in a tape automated bonding (TAB) type by using an anisotropic conductive film (ACF), and thus, the source drive ICs may be connected to the data lines DI1 to DLq.

The C-PCB may be attached on the flexible films. The timing controller 130 may be mounted on the C-PCB, and a plurality of signal lines that connect the timing controller 130 to the source drive ICs mounted on the flexible films may be arranged on the C-PCB.

The timing controller 130 may be supplied with digital video data DATA and a timing signal TS from the source side. The timing signal TS and the digital video data DATA may be input to an input terminal of the timing controller 130, based on a predetermined protocol. The timing signal TS may include a vertical sync signal VSYNC, a horizontal sync signal HSYNC, a data enable signal DE, and a dot clock DCLK. The timing controller 130 may be supplied with sensing data SD from the data driver 120. The timing controller 130 may compensate for the digital video data DATA, based on the sensing data SD.

The timing controller 130 may generate driver control signals for controlling the operation timings of the gate driver 110, the data driver 120, the scan driver, and the sensing driver. The driver control signals may include the gate driver control signal GCS for controlling the operation timing of the gate driver 110, the data driver control signal DCS for controlling the operation timing of the data driver 120, a scan driver control signal for controlling the operation timing of the scan driver, and a sensing driver control signal for controlling the operation timing of the sensing driver.

The timing controller 130 may operate the data driver 120, the scan driver, and the sensing driver in one of the display mode and the sensing mode according to a mode signal. The display mode may be a mode in which the pixels P of the display panel 100 display an image, and the sensing mode may be a mode in which a current of a driving transistor DT of each of the pixels P of the display panel 100 is sensed. When a waveform of the scan signal and a waveform of the sensing signal supplied to each of the pixels P are changed in each of the display mode and the sensing mode, the data driver control signal DCS, the scan driver control signal, and the sensing driver control signal may also be changed in each of the display mode and the sensing mode. Therefore, the timing controller 130 may generate the data driver control signal DCS, the scan driver control signal, and the sensing driver control signal according to one of the display mode and the sensing mode.

The timing controller 130 may output the gate driver control signal GCS to the gate driver 110. The timing controller 130 may output compensation digital video data and the data driver control signal DCS to the data driver 120. The timing controller 130 may output the scan driver control signal to the scan driver. The timing controller 130 may output the sensing driver control signal to the sensing driver.

Moreover, the timing controller 130 may generate a mode signal for executing one corresponding mode, in which the data driver 120, the scan driver, and the sensing driver are driven, of the display mode and the sensing mode. The timing controller 130 may operate the data driver 120, the scan driver, and the sensing driver in one of the display mode and the sensing mode according to the mode signal.

Figure 3:
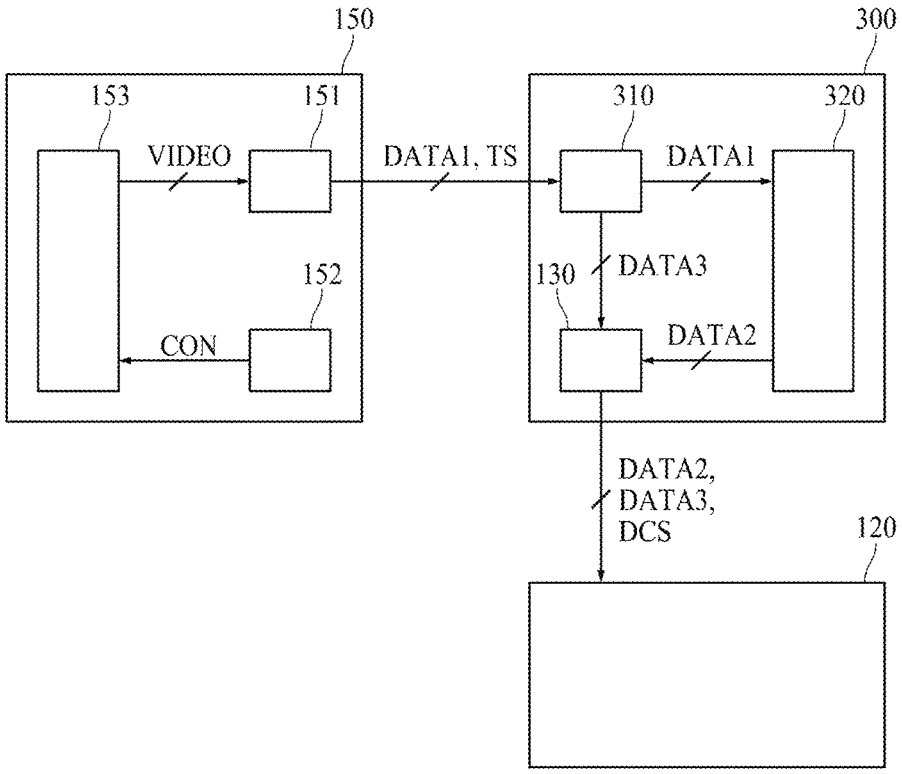
FIG. 3 is a block diagram showing flows of signals between a source side, a sync side, and a data driver of an organic light emitting display device according to an embodiment of the present disclosure.

FIG. 3 is a block diagram showing flows of signals between a source side 150, a sync side 300, and a data driver 120 of an organic light emitting display device according to an embodiment of the present disclosure.

The source side 150 may be considered as a source of each of second digital video data DATA2 and third digital video data DATA3 which are supplied from the timing controller 130 to the data driver 120, and thus, may be defined as a source side 150. The source side 150 may generate raw digital video data VIDEO and timing signals TS. The source side 150 may supply first digital video data DATA1, having a frame frequency which is set lower than that of the raw digital video data VIDEO, and the timing signals TS to the sync side 300. The source side 150 may include a display transmission port 151, a frame buffer controller 152, and a frame buffer 153.

The sync side 300 may be considered to actually control (i.e., sync) the data driver 120 which supplies a data voltage to the display panel 100, and thus, may be defined as a sync side. The sync side 300 may be supplied with the first digital video data DATA1 and the timing signals TS. The sync side 300 may supply the second digital video data DATA2, the third digital video data DATA3, and a data driver control signal DCS to the data driver 120. The sync side 300 may include a display reception port 310, a remote frame buffer 320, and a timing controller 130.

The data driver 120 may be supplied with the second digital video data DATA2, the third digital video data DATA3, and the data driver control signal DCS. The data driver 120 may respectively supply data voltages to the pixels P of the display panel 100 by using the supplied second digital video data DATA2, third digital video data DATA3, and data driver control signal DCS. The data driver 120 may be generally configured with a plurality of source drive ICs.

Hereinafter, detailed elements of the source side 150 and the sync side 300 will be described in detail.

The display transmission port (DP Tx) 151 may transmit digital video data DATA necessary for realizing an image on the display panel 100. The display transmission port 151 may be embedded into a chip and may be implemented with an embedded display transmission port (eDP Tx).

The display transmission port 151 may be supplied with the raw digital video data VIDEO from the frame buffer 153. The display transmission port 151 may supply the first digital video data DATA1, having a frame frequency which is set lower than that of the raw digital video data VIDEO, and the timing signals TS to the display reception port 310.

In a case where the source side 150 supplies the digital video data DATA to the sync side 300 in a state of maintaining the raw digital video data VIDEO as-is, a frame frequency of the raw digital video data VIDEO is high, and thus, a capacity of data is large. When transmitting data having a large capacity, power consumed by the source side 150 increases. Therefore, in order to decrease power consumption, the source side 150 may use a method which selectively transmits a number of frames equal to the number of frames restorable by the sync side 300 without supplying data of all frames.

That is, the source side 150 may omit some of active frames and may supply other active frames to the sync side 300. If the omitted some active frames are a half or less of all the active frames and the omitted some active frames are not successive, the sync side 300 may restore digital video data similarly to the raw digital video data VIDEO. To this end, as described below, the sync side 300 may copy digital video data of an active frame, which is adjacent to an omitted active frame, to the omitted active frame in the remote frame buffer 320 to generate the second digital video data DATA2. When a difference between digital video data of active frames adjacent to one another is not large, the second digital video data DATA2 may be similar to the raw digital video data VIDEO.

A PSR mode is applied to still images. The source side 150 determines whether supplied digital video data DATA represents a still image. When it is determined that the digital video data DATA represents the still image, the sync side 300 stores the digital video data DATA in the remote frame buffer 320 included therein. When the digital video data is stored in the remote frame buffer 320, the source side 150 stops the supply of the digital video data DATA. The sync side 300 autonomously drives the display panel 100 with the digital video data DATA stored in the remote frame buffer 320.

In a case where the PSR mode is applied, a frame frequency of the first digital video data DATA1 supplied from the display transmission port 151 to the display reception port 310 may be maintained lower than that of the raw digital video data VIDEO.

The frame buffer controller 152 may generate a frame buffer control signal CON for controlling whether to supply the raw digital video data VIDEO of the frame buffer 153. The frame buffer controller 152 may supply the frame buffer control signal CON to the frame buffer 153.

The frame buffer 153 may generate the raw digital video data VIDEO. The frame buffer 153 may be supplied with the frame buffer control signal CON from the frame buffer controller 152 and may supply the raw digital video data VIDEO, generated based on information included in the frame buffer control signal CON, to the display transmission port 151.

The display reception port (DP Rx) 310 may receive the digital video data DATA necessary for realizing an image on the display panel 100. The display reception port 310 may be embedded into a chip and may be implemented with an embedded display reception port (eDP Rx).

The display reception port 310 may be supplied with the first digital video data DATA1 and the timing signals TS from the display transmission port 151. The display reception port 310 may supply the first digital video data DATA1 to the remote frame buffer 320. The display reception port 310 may supply the third digital video data DATA3 to the timing controller 130.

The third digital video data DATA3 may include the same data content as that of the first digital video data DATA1. Also, the third digital video data DATA3 may have the same frame frequency as that of the first digital video data DATA1. The third digital video data DATA3 may be data where only information including a method of defining an omitted active frame in the display panel 100 is added to the first digital video data DATA1. For example, when the third digital video data DATA3 includes information which defines an omitted active frame as a frame for realizing a black image, an active frame omitted in the first digital video data DATA1 may be omitted in the third digital video data DATA3, and the timing controller 130 may regard the omitted active frame as a frame for realizing a black image.

The remote frame buffer 320 may be supplied with the first digital video data DATA1 from the display reception port 310. The remote frame buffer 320 may supply the second digital video data DATA2 to the timing controller 130.

Supplying the first digital video data DATA1 to the remote frame buffer 320 is for applying PSR technology and media buffer optimization (MBO) technology. Since the raw digital video data VIDEO should be restored from the first digital video data DATA1 for applying the PSR technology and the MBO technology, empty frames in the first digital video data DATA1 may be sequentially filled by using a method where the first digital video data DATA1 is stored, and then, is copied or duplicated in a next frame. The remote frame buffer 320 may generate the second digital video data DATA2 which includes data the most similar to the raw digital video data VIDEO and has the same frame frequency as that of the raw digital video data VIDEO, based on a method which uses an empty frame in the first digital video data DATA1 as-is by copying digital video data of an adjacent frame to the empty frame and may supply the second digital video data DATA2 to the timing controller 130.

The timing controller 130 may be supplied with the second digital video data DATA2 from the remote frame buffer 320 and may be supplied with the third digital video data DATA3 from the display reception port 310. The timing controller 130 may supply the second digital video data DATA2, the third digital video data DATA3, and the timing signals TS to the data driver 120.

The data driver 120 may respectively supply data voltages to the display panel 100 by using the second digital video data DATA2, the third digital video data DATA3, and the data driver control signal DCS.

Figure 4:
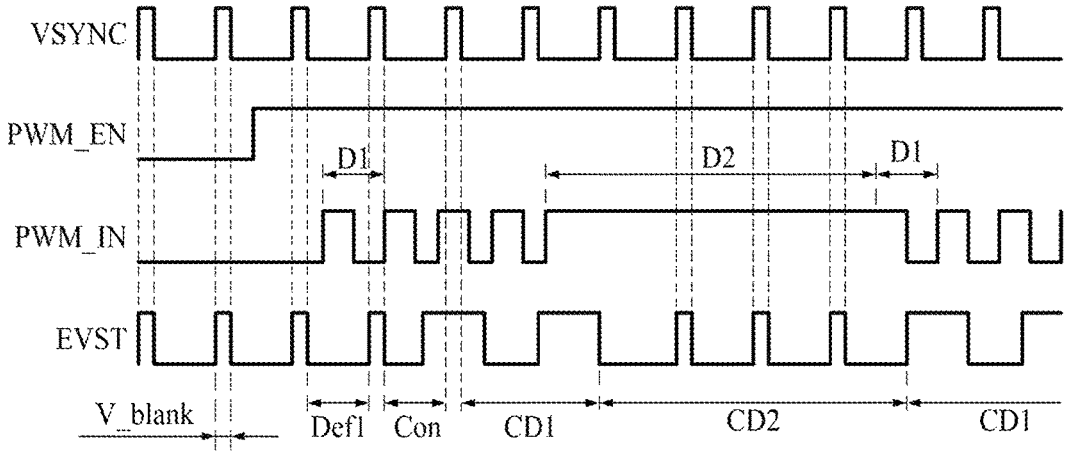
FIG. 4 is a waveform diagram showing a pulse width modulation in an organic light emitting display device according to an embodiment of the present disclosure.

FIG. 4 is a waveform diagram showing a pulse width modulation (PWM) in an organic light emitting display device according to an embodiment of the present disclosure.

A PWM may be a function of adjusting a whole luminance of the organic light emitting display device. If the PWM is applied, the timing controller 130 may supply an input PWM signal PWM_IN to the data driver 120. The data driver 120 may adjust a period where an organic light emitting diode (OLED) is turned on during one frame, so as to match a width of the input PWM signal PWM_IN.

A vertical sync signal VSYNC may define one frame period. As described above, the pixel P of the organic light emitting display device according to an embodiment of the present disclosure is assumed as using a PMOS transistor. Therefore, the vertical sync signal VSYNC may define one period having a low logic level as one frame period. At a time when a rising edge where the vertical sync signal VSYNC is shifted to a high logic level occurs, one frame may end, and a next frame may start.

A PWM enable signal PWM_EN may be a signal indicating that the PWM starts to be applied. If the PWM enable signal PWM_EN is at a low logic level, the PWM may not be applied. In a case where the PWM is not applied, the OLED may maximally emit light while the vertical sync signal VSYNC has a low logic level. In a case where the PWM is not applied, while the vertical sync signal VSYNC has a high logic level, the OLED may be put in a vertical blank state V_blank where light is not emitted. When the PWM enable signal PWM_EN has a high logic level, the PWM may be applied, and thus, a luminance of the OLED may be adjusted.

The input PWM signal PWM_IN may be a signal supplied to the data driver 120. The input PWM signal PWM_IN may adjust a period where the data driver 120 turns on the OLED during one frame, based on the width. The input PWM signal PWM_IN may not be synchronized with the vertical sync signal VSYNC. That is, the input PWM signal PWM_IN may be independent of the vertical sync signal VSYNC.

The input PWM signal PWM_IN may have a plurality of setting duty ratios D1 and D2 proportional to the width.

When the input PWM signal PWM_IN has a high logic level, the setting duty ratios D1 and D2 may be set based on the input PWM signal PWM_IN. In FIG. 4, an example where the setting duty ratios D1 and D2 is changed from a first setting duty ratio D1 to a second setting duty ratio D2 and then changed from the second setting duty ratio D2 to the first setting duty ratio D1 again is shown. The first setting duty ratio D1 may be 50%, and the second setting duty ratio D2 may be 100%.

An EVST signal EVST may control a luminance of the display panel 100. The EVST signal EVST may have a control duty ratio CD. The control duty ratio CD may be a ratio at which the OLED is actually turned on in one frame. The pixel P of the organic light emitting display device according to an embodiment of the present disclosure is assumed as using a PMOS transistor. Therefore, while the EVST signal EVST has a low logic level, the OLED may be turned on.

The EVST signal EVST may be driven based on a default duty Def in a first frame after the PWM mode is entered. The EVST signal EVST may be driven based on a control duty Con in a next frame after the PWM mode is entered. The EVST signal EVST may be driven based on a first control duty ratio CD1 via the control duty Con. When a control duty ratio is changed from the first control duty ratio CD1 to a second control duty ratio CD2, the EVST signal EVST may be driven based on the second control duty ratio CD2 without a separate preparation period.

Figure 5:
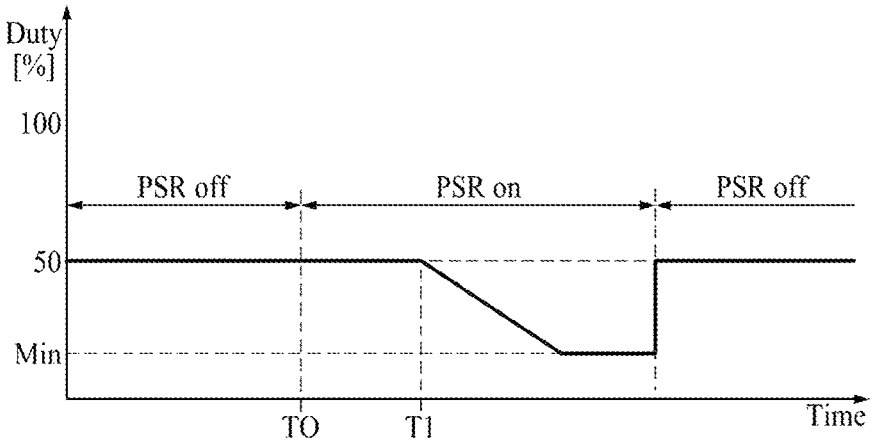
FIG. 5 is a graph showing a control duty ratio with respect to time in an organic light emitting display device according to an embodiment of the present disclosure.

FIG. 5 is a graph showing a control duty ratio with respect to time in an organic light emitting display device according to an embodiment of the present disclosure.

When a certain time elapses after entering the PSR mode of displaying a still image, the timing controller 130 of the organic light emitting display device according to an embodiment of the present disclosure may progressively decrease the control duty ratio for controlling the luminance of the display panel 100.

In more detail, as in FIG. 5, the organic light emitting display device is displaying a changed image until an initial time T0. Therefore, the PSR mode may not be applied before the initial time T0. That is, the PSR mode may be in an off state. In this case, the display panel 100 may be driven based on the setting duty ratio. That is, this may correspond to a case where the control duty ratio is the same as the setting duty ratio. In FIG. 5, an example where the setting duty ratio is 50% is shown.

The organic light emitting display device may display a still image from the initial time T0. In this case, the timing controller 130 may apply the PSR mode. That is, the PSR mode may become on. The timing controller 130 may measure a time which has elapsed from a time when the PSR mode becomes on. A method of measuring, by the timing controller 130, a time which has elapsed from a time when the PSR mode becomes on may be variously implemented. For example, by using a VCO clock generated by an internal oscillator of the timing controller 130, an elapsed time may be measured by counting the number of rising edges of the VCO clock from a time when the PSR mode becomes on. The timing controller 130 may determine whether the elapsed time is equal to or more than a threshold time, e.g., a predetermined certain time. In FIG. 5, an example where the certain time is a time from the initial time T0 to a first time T1 is assumed.

When the PSR mode continuously maintains an on state until the first time T1, the timing controller 130 may determine that the predetermined certain time has elapsed from after the display panel 100 enters the PSR mode. The timing controller 130 may determine that the display panel 100 continuously displays a still image for the threshold time, i.e., the threshold is met. That is, when the still image is displayed without any change, the timing controller 130 may determine that an OLED of a pixel provided in a specific area of the display panel 100 displaying an area where a luminance of the still image is high can be burned in.

When the PSR mode continuously maintains an on state until the first time T1, the timing controller 130 may progressively decrease the control duty ratio for controlling the luminance of the display panel 100 from after the first time T1. A slope at which the control duty ratio is reduced may be variably adjusted. An operation of progressively decreasing the control duty ratio may be implemented by adding a command, which allows the control duty ratio to be progressively reduced, to a program which drives an IC chip embedded into the timing controller 130.

If the timing controller 130 progressively decreases the control duty ratio, the luminance of the display panel 100 is progressively reduced. Therefore, a high-luminance area may be continuously displayed without user's recognizing a rapid reduction in luminance, thereby preventing an OLED from being burned in.

The timing controller 130 according to an embodiment of the present disclosure may progressively decrease the control duty ratio irrespective of the setting duty ratio in the input PWM signal PWM_IN. For example, in FIG. 5, the setting duty ratio may maintain 50% as-is, and only the control duty ratio may be reduced.

In order to change the setting duty ratio, the width of the input PWM signal PWM_IN should be changed. An internal circuit should be separately changed for changing the width of the input PWM signal PWM_IN. Also, when an error occurs, the setting duty ratio cannot be changed to have a desired value.

However, when the threshold time, e.g., predetermined certain time, elapses from after entering the PSR mode, the timing controller 130 according to an embodiment of the present disclosure may overall and progressively decrease the control duty ratio irrespective of the setting duty ratio. That is, the timing controller 130 may overall and progressively decrease the control duty ratio separately than the setting duty ratio. Therefore, the internal circuit may not be separately changed when changing the setting duty ratio. Also, even when the setting duty ratio is not changed to have a desired value due to occurrence of an error, the control duty ratio may be progressively reduced, thereby preventing the OLED from being burned in due to an error of the setting duty ratio.

The timing controller 130 according to an embodiment of the present disclosure may progressively decrease a control duty ratio of the EVST signal EVST, which controls the luminance of the display panel 100, to a lowest duty ratio which is a duty ratio for realizing the lowest luminance of the display panel 100.

The EVST signal EVST may directly control the luminance of the display panel 100. The EVST signal EVST may vary a value of an EVST voltage for controlling an emission driver (EM driver). When varying the value of the EVST voltage, an EMO signal which is an output of the emission driver may vary. When decreasing the control duty ratio of the EVST signal EVST, the EMO signal may vary so as to shorten a time for which the OLED is turned on during one frame.

The lowest duty ratio may be a duty ratio for realizing the lowest luminance of the display panel 100. In a duty ratio which is lower than the lowest duty ratio, an image is not recognized in the display panel 100. Therefore, the lowest duty ratio may be a duty ratio for obtaining minimum luminance which enables an image to be recognized in the display panel 100. The lowest duty ratio may vary depending on the kind of the organic light emitting display device and may be set to a value of 10% to 30%. In an example, the lowest duty ration may be dynamically controllable and/or adjustable.

When the timing controller 130 according to an embodiment of the present disclosure continuously decreases the control duty ratio in the PSR mode of displaying a still image, an image cannot be recognized in the display panel 100 at all. In this case, a user can delude itself that the display panel 100 is in a turn-off state. The timing controller 130 according to an embodiment of the present disclosure may allow the display panel 100 to maintain minimum luminance which enables an image to recognized, and thus, a state which enables an image displayed on the display panel 100 to be recognized is maintained in addition to preventing the OLED from being burned in.

The timing controller 130 according to an embodiment of the present disclosure may drive the display panel 100 at the lowest duty ratio while the PSR mode is being maintained. While the PSR mode is being maintained, the display panel 100 may continuously display a still image. Accordingly, the display panel 100 may be driven at the lowest duty ratio while the still image is being displayed, thereby preventing the OLED from being burned in.

Whether the PSR mode is maintained or not may be determined by checking whether data of the remote frame buffer 320 or data of the source side 150 is used. It may be determined that the PSR mode is maintained while the data of the remote frame buffer 320 is used. Therefore, even without adding a separate element, the timing controller 130 according to an embodiment of the present disclosure may maintain the control duty ratio as the lowest duty ratio while the PSR mode is maintained.

After the PSR mode ends, the timing controller 130 according to an embodiment of the present disclosure may restore the control duty ratio to the setting duty ratio. The timing controller 130 may determine that the PSR mode ends from a time when the use of the data of the remote frame buffer 320 is stopped and the data of the source side 150 starts to be used. Even without adding a separate element, the timing controller 130 may know a time when the PSR mode ends.

In an embodiment of the present disclosure, when the PSR mode ends, it may be determined that the display panel 100 does not maintain a still image and returns to a state of displaying a moving image again. In a case of displaying a moving image, a possibility that the OLED will be burned in is low. In an embodiment of the present disclosure, in a case of displaying a moving image, the control duty ratio may be restored to the setting duty ratio. In FIG. 5, it can be confirmed that the control duty ratio is restored to the setting duty ratio "50%" immediately after the PSR mode ends. Accordingly, in an embodiment of the present disclosure, when the PSR mode ends, a moving image may be displayed at normal luminance.

Figure 6:
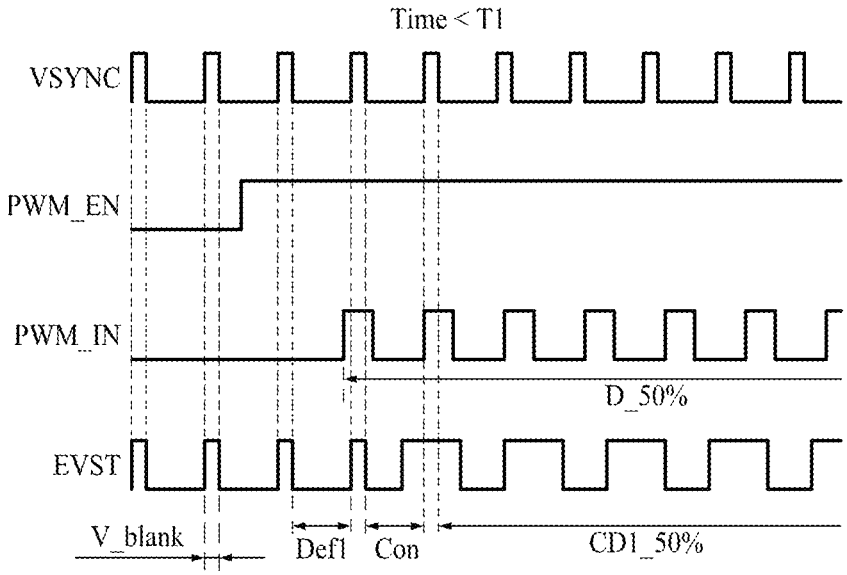
FIG. 6 is a waveform diagram showing a pulse width modulation prior to a first time in an organic light emitting display device according to an embodiment of the present disclosure.

FIG. 6 is a waveform diagram showing a pulse width modulation previous to a first time T1 in an organic light emitting display device according to an embodiment of the present disclosure.

Before the first time T1, all of a setting duty ratio and a control duty ratio are constant. In FIG. 6, an example where each of the setting duty ratio and the control duty ratio is 50% is shown.

A vertical sync signal VSYNC may define one frame period. As described above, the pixel P of the organic light emitting display device according to an embodiment of the present disclosure is assumed as using a PMOS transistor. Therefore, the vertical sync signal VSYNC may define one period having a low logic level as one frame period. At a time when a rising edge where the vertical sync signal VSYNC is shifted to a high logic level occurs, one frame may end, and a next frame may start.

A PWM enable signal PWM_EN may be a signal indicating that the PWM starts to be applied. If the PWM enable signal PWM_EN is at a low logic level, the PWM may not be applied. In a case where the PWM is not applied, the OLED may maximally emit light while the vertical sync signal VSYNC has a low logic level. In a case where the PWM is not applied, while the vertical sync signal VSYNC has a high logic level, the OLED may be put in a vertical blank state V_blank where light is not emitted. When the PWM enable signal PWM_EN is at a high logic level, the PWM may be applied, and thus, a luminance of the OLED may be adjusted.

The input PWM signal PWM_IN may be a signal supplied to the data driver 120. The input PWM signal PWM_IN may have a width of 50%. The input PWM signal PWM_IN may adjust a period, where the data driver 120 turns on the OLED during one frame, to 50%. The input PWM signal PWM_IN may not be synchronized with the vertical sync signal VSYNC. That is, the input PWM signal PWM_IN may be independent of the vertical sync signal VSYNC.

The input PWM signal PWM_IN may have a setting duty ratio D_50% proportional to the width. When the input PWM signal PWM_IN has a high logic level, the setting duty ratio D_50% may be set to a duty ratio of 50%, based on the input PWM signal PWM_IN.

An EVST signal EVST may control a luminance of the display panel 100. The EVST signal EVST may have a control duty ratio CD_50% of 50%. The control duty ratio CD_50% of 50% may denote that the OLED is actually turned on by 50% in one frame. The pixel P of the organic light emitting display device according to an embodiment of the present disclosure is assumed as using a PMOS transistor. Therefore, while the EVST signal EVST has a low logic level, the OLED may be turned on.

The EVST signal EVST may be driven based on a default duty Def in a first frame after the PWM mode is entered. The EVST signal EVST may be driven based on a control duty Con in a next frame after the PWM mode is entered. The EVST signal EVST may be driven based on the control duty ratio CD_50% of 50% via the control duty Con.

Figure 7:
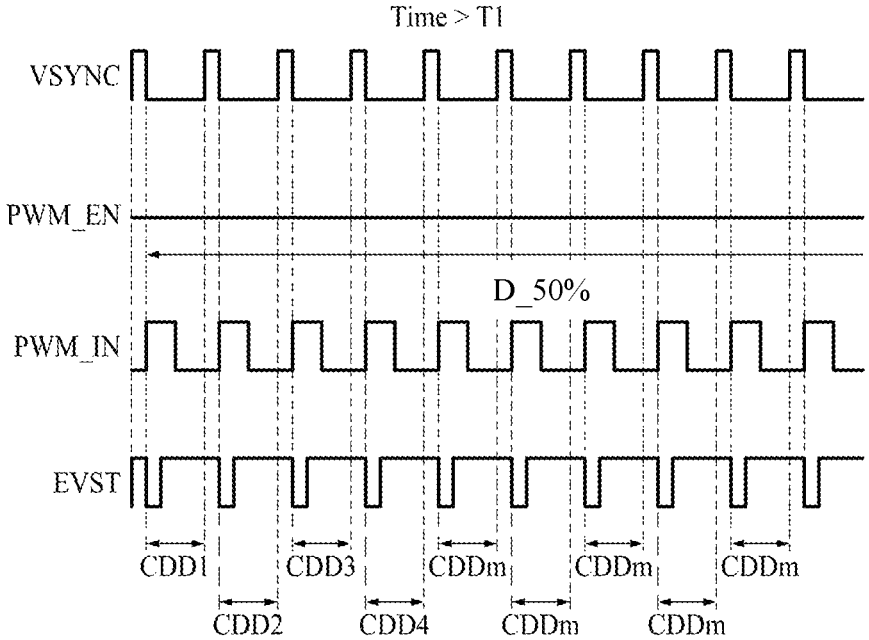
FIG. 7 is a waveform diagram showing a pulse width modulation subsequent to a first time in an organic light emitting display device according to an embodiment of the present disclosure.

FIG. 7 is a waveform diagram showing a pulse width modulation subsequent to a first time T1 in an organic light emitting display device according to an embodiment of the present disclosure.

A vertical sync signal VSYNC may define one frame period. As described above, the pixel P of the organic light emitting display device according to an embodiment of the present disclosure is assumed as using a PMOS transistor. Therefore, the vertical sync signal VSYNC may define one period having a low logic level as one frame period. At a time when a rising edge where the vertical sync signal VSYNC is shifted to a high logic level occurs, one frame may end, and a next frame may start.

A PWM enable signal PWM_EN may be a signal indicating that the PWM starts to be applied. The PWM enable signal PWM_EN may always have a high logic level after the first time T1, and thus, the PWM may be applied, whereby a luminance of the OLED may be adjusted.

The input PWM signal PWM_IN may be a signal supplied to the data driver 120. The input PWM signal PWM_IN may have a width of 50%. The input PWM signal PWM_IN may adjust a period, where the data driver 120 turns on the OLED during one frame, to 50%. The input PWM signal PWM_IN may not be synchronized with the vertical sync signal VSYNC. That is, the input PWM signal PWM_IN may be independent of the vertical sync signal VSYNC.

The input PWM signal PWM_IN may have a setting duty ratio D_50% proportional to the width. When the input PWM signal PWM_IN has a high logic level, the setting duty ratio D_50% may be set to a duty ratio of 50%, based on the input PWM signal PWM_IN.

An EVST signal EVST may control a luminance of the display panel 100. The EVST signal EVST may have a plurality of control duty ratios CD1 to CD4 which are progressively reduced. The progressively reduced plurality of control duty ratios CD1 to CD4 may denote that the OLED is turned on to have a ratio which is actually and progressively reduced in a direction toward subsequent frames. The pixel P of the organic light emitting display device according to an embodiment of the present disclosure is assumed as using a PMOS transistor. Therefore, while the EVST signal EVST has a low logic level, the OLED may be turned on.

The EVST signal EVST may be driven based on a first reduction control ratio CDD1 in a first frame after the PWM mode is entered. The EVST signal EVST may be driven based on a second reduction control ratio CDD2 in a second frame after the first time T1. The EVST signal EVST may be driven based on a third reduction control ratio CDD3 in a third frame after the first time T1. The EVST signal EVST may be driven based on a fourth reduction control ratio CDD4 in a fourth frame after the first time T1. The EVST signal EVST may be driven based on a minimum duty ratio CDDm via, for example, the first to fourth reduction control duty ratios CDD1 to CDD4. It should be appreciated that the first to fourth reduction control duty ratios CDD1 to CDD4 are used herein for illustrative purposes only and the EVST signal EVST may be driven based on a minimum duty ratio CDDm via various number of reduction control duty ratios, e.g., six reduction control duty ratios CDD1 to CDD6, according to different system configurations and/or dynamic system controls and/or setups.

The example first to fourth reduction control duty ratios CDD1 to CDD4 may be lower than a duty ratio previous to the first time T1 and may be higher than the minimum control duty ratio CDDm. Therefore, for example, the first to fourth control duty ratios CDD1 to CDD4 may be lower than 50%. Also, as described above, the minimum control duty ratio CDDm may have a set value of 10% to 30%, and thus, first to fourth reduction control duty ratios CDD1 to CDD4 may be higher than the minimum control duty ratio CDDm which is set.

The second reduction control duty ratio CDD2 may be lower than the first reduction control duty ratio CDD1. Also, the third reduction control duty ratio CDD3 may be lower than the second reduction control duty ratio CDD2. Also, the fourth reduction control duty ratio CDD4 may be lower than the third reduction control duty ratio CDD3. That is, a duty ratio may be progressively reduced in a direction from the first reduction control duty ratio CDD1 to the fourth reduction control duty ratio CDD4. As a detailed example, the first reduction control duty ratio CDD1 may be set to 45%, the second reduction control duty ratio CDD2 may be set to 40%, the third reduction control duty ratio CDD3 may be set 35%, and the fourth reduction control duty ratio CDD4 may be set to 30%. Accordingly, a progressively reduced duty ratio may be realized.

A driving method of the organic light emitting display device according to an embodiment of the present disclosure may include an operation of controlling, the timing controller 130, the data driver 120, an operation of supplying, by the data driver 120, a data voltage to the display panel 100, and an operation of displaying, by the display panel 100, an image. When a certain time elapses after the display panel 100 enters the PSR mode of displaying a still image, the timing controller 130 according to an embodiment of the present disclosure may progressively decrease the control duty ratio CD which controls the luminance of the display panel 100.

Figure 8:
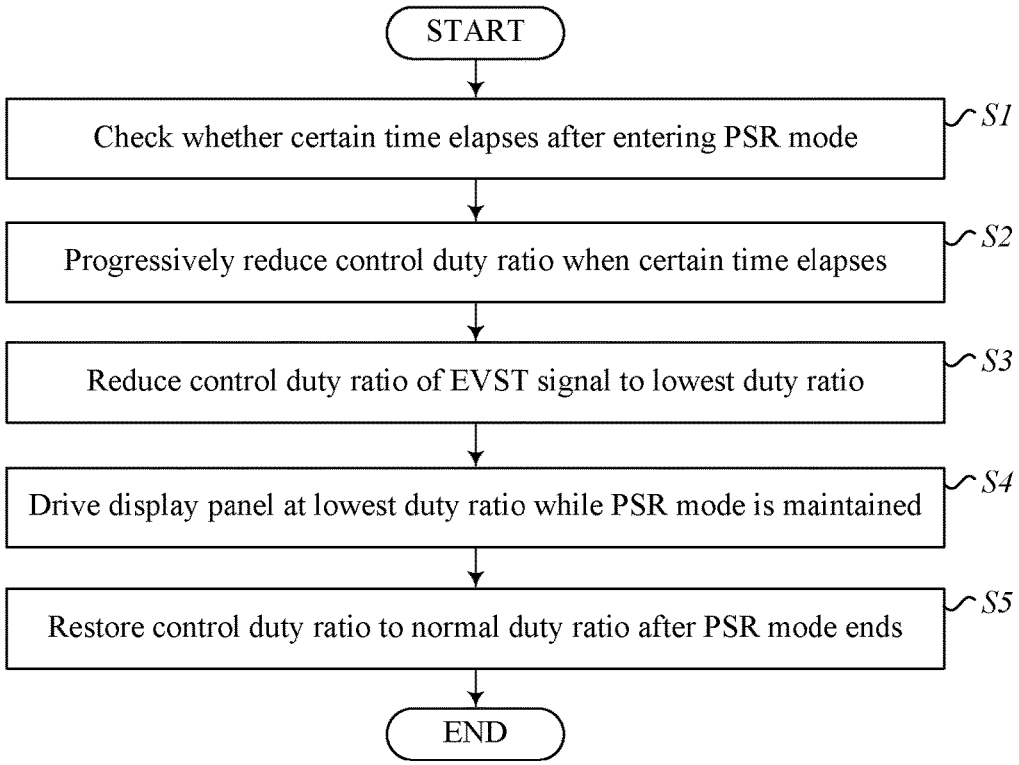
FIG. 8 is a flowchart illustrating in detail a process of controlling, by a timing controller, a data driver in a driving method of an organic light emitting display device according to an embodiment of the present disclosure.

FIG. 8 is a flowchart illustrating in detail a process of controlling, by the timing controller 130, a data driver in a driving method of the organic light emitting display device according to an embodiment of the present disclosure.

First, the timing controller 130 according to an embodiment of the present disclosure may check whether a time for which the PSR mode is maintained elapses by a predetermined certain time, i.e., a threshold time, after entering the PSR mode. The certain time may be a set value and/or may be variable/adjustable. The certain time may be set to a time when there is a possibility that an OLED is burned in if a still image is continuously maintained. Therefore, the certain time may be set to a suitable time, based on a physical characteristic of the OLED and a luminance of the still image. (S1 of FIG. 8)

Second, when the certain time elapses in a state of maintaining the PSR mode after entering the PSR mode, the timing controller 130 according to an embodiment of the present disclosure may progressively decrease a control duty ratio irrespective of a setting duty ratio based on the input PWM signal PWM_IN. A reduction slope of the control duty ratio may vary. A variation of the setting duty ratio may be performed by varying the width of the input PWM signal PWM_IN. Therefore, a separate element or an additional input signal is needed. However, even without the separate element or the additional input signal, the timing controller 130 according to an embodiment of the present disclosure may progressively reduce the control duty ratio so as to prevent the OLED from being burned in. (S2 of FIG. 8)

Third, the timing controller 130 according to an embodiment of the present disclosure may progressively reduce a control duty ratio of the EVST signal EVST, which controls the luminance of the display panel 100, to a lowest duty ratio which is a duty ratio for realizing the lowest luminance of the display panel 100. The lowest duty ratio may be a duty ratio which realizes minimum luminance necessary for recognizing an image displayed on the display panel 100. Therefore, the timing controller 130 may reduce the control duty ratio to a degree to which an image is recognized in the display panel 100. Accordingly, a state which enables a user to recognize an image displayed on the display panel 100 is maintained, and moreover, the OLED is prevented from being burned in. (S3 of FIG. 8)

Fourth, while the PSR mode is maintained, the timing controller 130 according to an embodiment of the present disclosure may drive the display panel 100 at the lowest duty ratio. The still image may be maintained while the PSR mode is maintained. Therefore, while the PSR mode is maintained, it can be considered that a possibility that the OLED will be burned in is high. When data stored in the remote frame butter 320 is used, the timing controller 130 may determine that the PSR mode is maintained, and may drive the display panel 100 at the lowest duty ratio. Accordingly, while the PSR mode is maintained, the OLED is prevented from being burned in. (S4 of FIG. 8)

Fifth, the timing controller 130 according to an embodiment of the present disclosure may restore the control duty ratio to a setting duty ratio which is a normal duty ratio before entering the PSR mode after the PSR mode ends. The timing controller 130 may stop the use of the data stored in the remote frame buffer 320 and may determine that a time when data supplied from the source side 150 is used is a time when the PSR mode ends. The display panel 100 may display, instead of the still image, a moving image from the time when the PSR mode ends. Accordingly, when an environment where a possibility that the OLED is burned in is low arrives, the timing controller 130 may restore the control duty ratio to the setting duty ratio to cause the display panel 100 to display an image having normal luminance. (S5 of FIG. 8)

As a result, when a certain time elapses after the display panel enters the PSR mode of displaying a still image, the timing controller according to an embodiment of the present disclosure may progressively decrease the control duty ratio for controlling the luminance of the display panel. Also, the timing controller prevents the OLED from being burned in when a still image is displayed. Therefore, according to the embodiments of the present disclosure, a lifetime of the OLED is enhanced. Also, according to the embodiments of the present disclosure, without an additional logic circuit for determining a still image, by checking whether the PSR mode is entered or not, the OLED is prevented from being burned in when a still image is displayed.

As described above, according to the embodiments of the present disclosure, the timing controller prevents each OLED from being burned in when a still image is displayed. Therefore, according to the embodiments of the present disclosure, a lifetime of each OLED is enhanced. Also, according to the embodiments of the present disclosure, without an additional logic circuit for determining a still image, by checking whether the PSR mode is entered or not, each OLED is prevented from being burned in when a still image is displayed.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. An organic light emitting display device comprising:

a display panel configured to display an image;

a data driver configured to supply a data voltage to the display panel; and a timing controller configured to control the data driver in a manner that, in operation, when a threshold time elapses after the display panel enters a panel self-refresh (PSR) mode of displaying a still image, the timing controller progressively reduces a control duty ratio which controls a luminance of the display panel while the display panel is still in the PSR mode;

wherein the display panel comprises a plurality of pixels including an organic light emitting diode;

wherein the organic light emitting diode is turned on under control of the control duty ratio in one frame while the PSR mode is maintained; and wherein the control duty ratio is lower than 50%.

2. The organic light emitting display device of claim 1, wherein the timing controller progressively reduces the control duty ratio separately than a setting duty ratio in an input pulse width modulation (PWM) signal.

3. The organic light emitting display device of claim 2, wherein the timing controller progressively reduces a control duty ratio of a luminance control signal (EVST), which controls the luminance of the display panel, to a lowest duty ratio which is a duty ratio for realizing a lowest luminance of the display panel.

4. The organic light emitting display device of claim 3, wherein the timing controller drives the display panel at the lowest duty ratio while the PSR mode is maintained.

5. The organic light emitting display device of claim 4, wherein after the PSR mode ends, the timing controller restores the control duty ratio to the setting duty ratio.

6. The organic light emitting display device of claim 1, wherein the control duty ratio have a set value of 10% to 30%.

7. A driving method of an organic light emitting display device, the driving method comprising:

controlling, by a timing controller, a data driver;

supplying, by the data driver, a data voltage to a display panel;

displaying, by the display panel, an image entering a panel self-refresh mode (PSR) mode of image display; and when a threshold time has elapsed after entering the PSR mode of image display, progressively reducing a control duty ratio to control a luminance of the display panel while the display panel is still in the PSR mode;

wherein the display panel comprises a plurality of pixels including an organic light emitting diode;

wherein the organic light emitting diode is turned on under control of the control duty ratio in one frame while the PSR mode is maintained; and wherein the control duty ratio is lower than 50%.

8. The driving method of claim 7, wherein the controlling of the data driver includes progressively reducing the control duty ratio separately than a setting duty ratio in an input pulse width modulation (PWM) signal.

9. The driving method of claim 8, wherein the controlling of the data driver includes progressively reducing a control duty ratio of a luminance control signal (EVST), which controls the luminance of the display panel, to a lowest duty ratio which is a duty ratio for realizing a lowest luminance of the display panel.

10. The driving method of claim 9, wherein the controlling of the data driver comprises controlling to drive the display panel at the lowest duty ratio while the PSR mode is maintained.

11. The driving method of claim 10, wherein the controlling of the data driver comprises, after the PSR mode ends, restoring the control duty ratio to the setting duty ratio.

12. The driving method of claim 7, wherein the control duty ratio have a set value of 10% to 30%.

* * * * *